US011006701B2

(12) United States Patent
Huang et al.

(10) Patent No.: US 11,006,701 B2
(45) Date of Patent: May 18, 2021

(54) RECLOSABLE FASTENER STRIP

(71) Applicants: Chen-Cheng Huang, Taipei (TW); Pao-Hao Huang, Taipei (TW); Pao-Han Huang, Taipei (TW)

(72) Inventors: Chen-Cheng Huang, Taipei (TW); Pao-Hao Huang, Taipei (TW); Pao-Han Huang, Taipei (TW)

( * ) Notice: Subject to any disclaimer, the term of this patent is extended or adjusted under 35 U.S.C. 154(b) by 0 days.

(21) Appl. No.: 16/813,403

(22) Filed: Mar. 9, 2020

(65) Prior Publication Data

US 2020/0288824 A1 Sep. 17, 2020

(30) Foreign Application Priority Data

Mar. 11, 2019 (TW) ..... 108107973
Apr. 30, 2019 (CN) ..... 201910359821.7
Sep. 12, 2019 (TW) ..... 108132922

(51) Int. Cl.
*A44B 18/00* (2006.01)

(52) U.S. Cl.
CPC ..... *A44B 18/0007* (2013.01); *A44B 18/0053* (2013.01); *A44D 2200/12* (2013.01); *A44D 2205/00* (2013.01)

(58) Field of Classification Search
CPC ... A41F 1/00; A44B 18/0007; A44B 18/0053; A44B 19/16; A44D 2200/12; A44D 2205/00
See application file for complete search history.

(56) References Cited

U.S. PATENT DOCUMENTS 4,673,383 A * 6/1987 Bentsen ..... B29C 66/7392 156/244.15
6,367,128 B1 * 4/2002 Galkiewicz ..... A44B 18/0053 24/572.1
2001/0044991 A1 * 11/2001 Graves ..... A44B 19/16 24/400
2006/0168774 A1 * 8/2006 Pawloski ..... B65D 33/2591 24/399
2013/0305500 A1 * 11/2013 Septien Rojas .... A44B 18/0061 24/586.11
2014/0119678 A1 * 5/2014 Ausnit ..... A44B 19/32 383/64
2017/0265603 A1 * 9/2017 Ronsen ..... A44B 18/0011

FOREIGN PATENT DOCUMENTS

TW 201808738 A 3/2018
TW I675782 B 11/2019
WO 2007/116518 A1 10/2007

OTHER PUBLICATIONS

Search Report issued in corresponding European patent application, EP 20162020, dated Jul. 20, 2020 (8 pages).

* cited by examiner

*Primary Examiner* — Robert Sandy
*Assistant Examiner* — David M Upchurch
(74) *Attorney, Agent, or Firm* — Hamre, Schumann, Mueller & Larson, P.C.

(57) ABSTRACT

A reclosable fastener strip includes first and second strip halves each having a strip body and two hook units. Each hook unit has at least one pair of elongated hooks formed on a major surface of the strip body and cooperatively defining a recess therebetween. Each elongated hook is configured and dimensioned to permit being fitted securely in the recess of a corresponding pair of the elongated hooks so as to provide a suitable watertight seal.

16 Claims, 21 Drawing Sheets

RECLOSABLE FASTENER STRIP

CROSS-REFERENCE TO RELATED APPLICATION

This application claims priority of Taiwanese Patent Application No. 108107973, filed on Mar. 11, 2019, of Taiwanese Patent Application No. 108132922, filed on Sep. 12, 2019, and of Chinese Patent Application No. 201910359821.7, filed on Apr. 30, 2019.

FIELD

The disclosure relates to a reclosable fastener strip, and more particularly to a reclosable fastener strip capable of being opened and closed for sealing an opening of a garment.

BACKGROUND

A conventional design for opening and closing two parts of a garment utilizes a button or a zipper fastener. However, these fasteners do not work well to prevent water from passing therethrough. For instance, water may enter inside the garment from clearances in the zipper fastener.

SUMMARY

Therefore, an object of the disclosure is to provide a reclosable fastener strip that can alleviate at least one of the drawbacks of the prior art.

According to the disclosure, the reclosable fastener strip includes first and second strip halves. The first strip half includes a first strip body which is elongated in a lengthwise direction and which has a first major surface that faces in an engaging direction transverse to the lengthwise direction, and first and second long side edges opposite to each other in a lateral direction transverse to both the lengthwise and engaging directions, and two first hook units which are spaced apart from each other in the lateral direction. Each of the first hook units has at least one pair of first elongated hooks. Each of the first elongated hooks is formed on the first major surface and is elongated in the lengthwise direction. The first elongated hooks of each pair are respectively disposed proximate to the first and second long side edges and cooperatively define a first recess therebetween. The second strip half includes a second strip body which is elongated in the lengthwise direction and which has a second major surface that faces in the engaging direction and the first major surface, and third and fourth long side edges opposite to each other in the lateral direction, and two second hook units which are spaced apart from each other in the lateral direction. Each of the second hook units has at least one pair of second elongated hooks. Each of the second elongated hooks is formed on the second major surface and is elongated in the lengthwise direction. The second elongated hooks of each pair are respectively disposed proximate to the third and fourth long side edges and cooperatively define a second recess therebetween. Each of the first and second elongated hooks is configured and dimensioned to permit each of the first elongated hooks to be fitted securely in the second recess, and to permit each of the second elongated hooks to be fitted securely in the first recess.

BRIEF DESCRIPTION OF THE DRAWINGS

Other features and advantages of the disclosure will become apparent in the following detailed description of the embodiments with reference to the accompanying drawings, of which.

DETAILED DESCRIPTION

Figure 1:
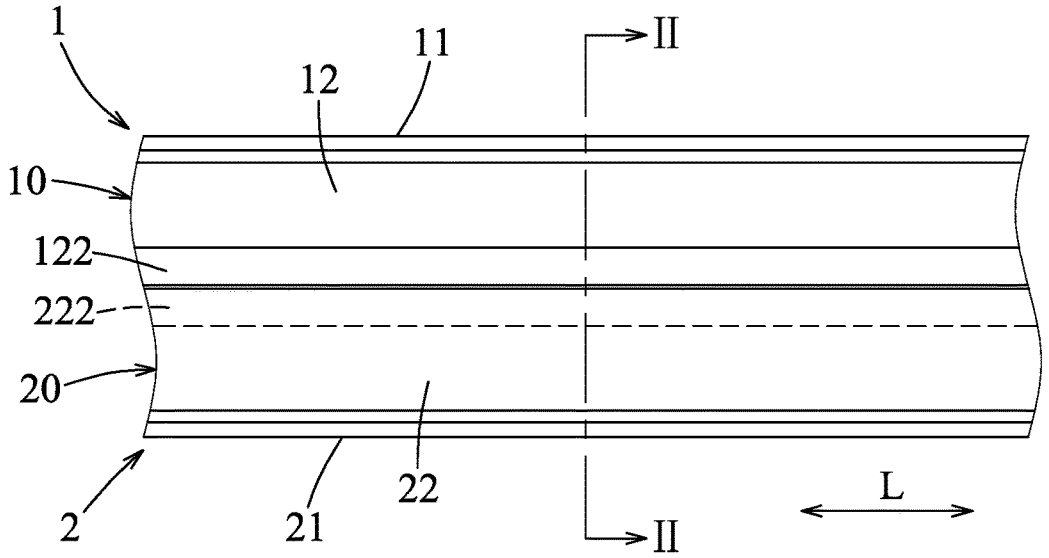
FIG. 1 is a fragmentary side view illustrating a first embodiment of a reclosable fastener strip according to the disclosure.

Before the disclosure is described in greater detail, it should be noted that where considered appropriate, reference numerals or terminal portions of reference numerals have been repeated among the figures to indicate corresponding or analogous elements, which may optionally have similar characteristics.

Figure 2:
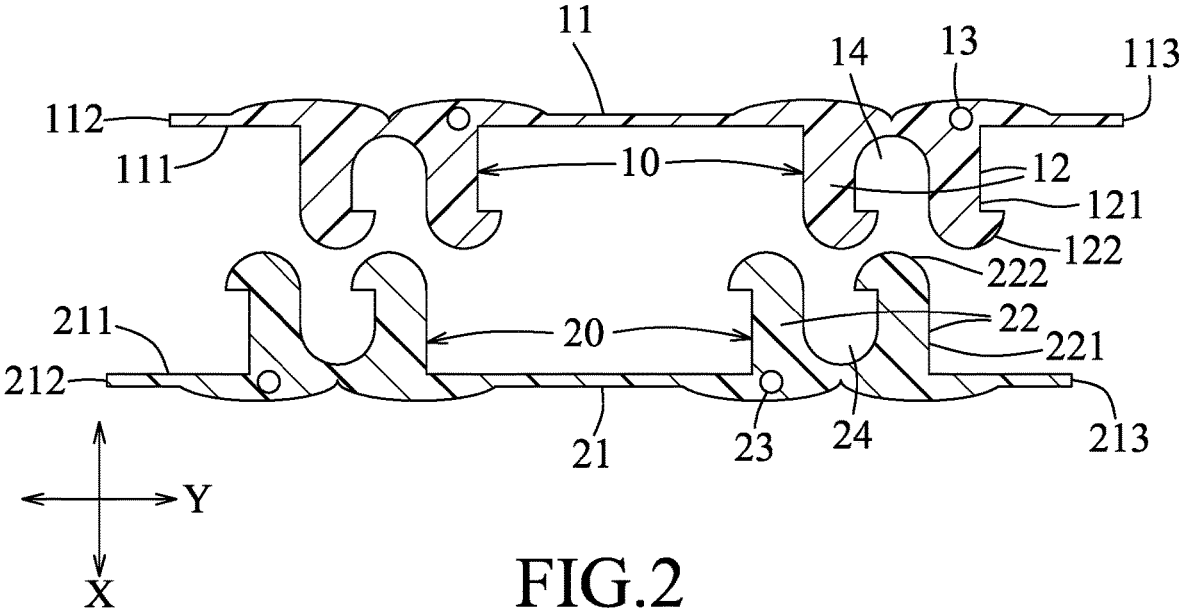
FIG. 2 is a sectional view taken along line II-II of FIG. 1.

Referring to FIGS. 1 and 2, the first embodiment of the reclosable fastener strip according to the disclosure is adapted to be mounted to a garment (not shown) for fastening two piece parts of the garment, such as left and right plackets, junctures of a collar, junctures of a hood, etc. In this embodiment, the reclosable fastener strip includes a first strip half 1 and a second strip half 2 which are mounted on left and right plackets, respectively. The reclosable fastener strip is also adaptable to be mounted on a bag for closing a pouch thereof.

The first strip half 1 includes a first strip body 11 and two first hook units 10. The first strip body 11 is elongated in a lengthwise direction (L), and has a first major surface 111 which faces in an engaging direction (X) transverse to the lengthwise direction (L), and first and second long side edges 112, 113 opposite to each other in a lateral direction (Y) transverse to both the lengthwise direction (L) and the engaging direction (X). The first hook units 10 are spaced apart from each other in the lateral direction (Y) to be proximate to the first and second long side edges 112, 113, respectively. Each of the first hook units 10 has a pair of first elongated hooks 12 and a first electroconductive fiber 13. The first elongated hooks 12 of each pair are formed on the first major surface 111 and respectively proximate to the first and second long side edges 112, 113, and are elongated in the lengthwise direction (L) to cooperatively define a first recess 14 therebetween. Each first elongated hook 12 includes a first neck portion 121 which projects from the first major surface 111 in the engaging direction (X) to terminate at a first enlarged head hook portion 122 which is spaced apart from the first major surface 111. The first enlarged head hook portion 122 is of a half arrowhead shape in this embodiment. The first electroconductive fiber 13 is embedded in the first strip body 11 and extends in the lengthwise direction (L) for providing a conductive path of electrically conductive textiles. The first electroconductive fiber 13 may be also embedded in one of the first elongated hooks 12.

Figure 3:
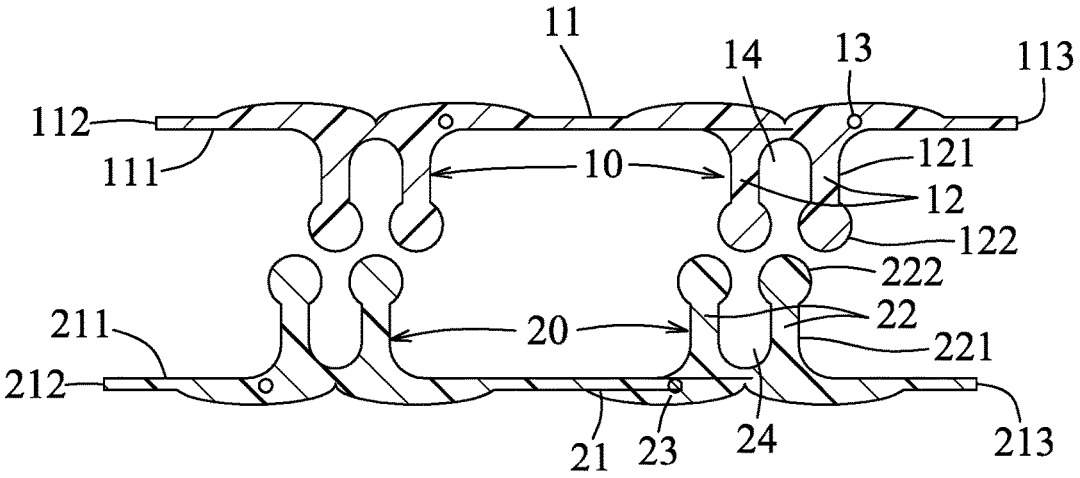
FIG. 3 is a sectional view similar to FIG. 2, illustrating the first embodiment in a modified form.

The second strip half 2 includes a second strip body 21 and two second hook units 20. The second strip body 21 is elongated in the lengthwise direction (L), and has a second major surface 211 which faces in the engaging direction (X) and the first major surface 111, and third and fourth long side edges 212, 213 opposite to each other in the lateral direction (Y). The second hook units 20 are spaced apart from each other in the lateral direction (Y) to be proximate to the third and fourth long side edges 212, 213, respectively. Each of the second hook units 20 has a pair of second elongated hooks 22 and a second electroconductive fiber 23. Each second elongated hook 22 is formed on the second major surface 211 and is elongated in the lengthwise direction (L). The second elongated hooks 22 of each pair are respectively disposed proximate to the third and fourth long side edges 212, 213 and cooperatively define a second recess 24 therebetween. Each second elongated hook 22 is capable of being fitted securely in the first recess 14, and includes a second neck portion 221 which projects from the second major surface 211 in the engaging direction (X) to terminate at a second enlarged head hook portion 222 which is spaced apart from the second major surface 211. The second enlarged head hook portion 222 is of a half arrowhead shape in this embodiment. Each first elongated hook 12 is capable of being fitted securely in the second recess 24. The second electroconductive fiber 23 is embedded in the second strip body 21 and extends in the lengthwise direction (L) for providing a conductive path of electrically conductive textiles. The second electroconductive fiber 23 may be also embedded in one of the second elongated hooks 22. Alternatively, referring to FIG. 3, each of the first and second enlarged head hook portions 122, 222 may be of a bulbous shape. In one variant embodiment, the first and second strip halves 1, 2 may not include the first and second electroconductive fibers 13, 23.

Figure 4:
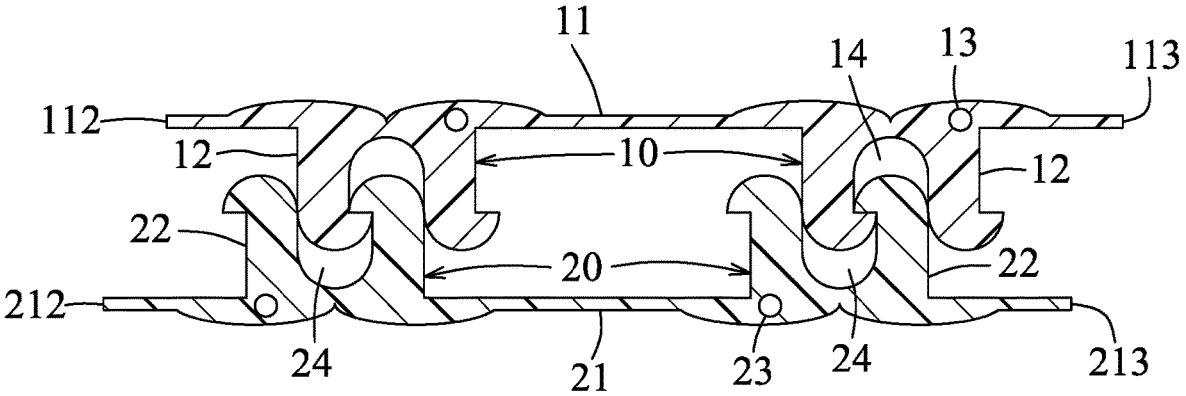
FIG. 4 is a sectional view similar to FIG. 2, illustrating first and second strip halves of the first embodiment in a first engaging state.
Figure 5:
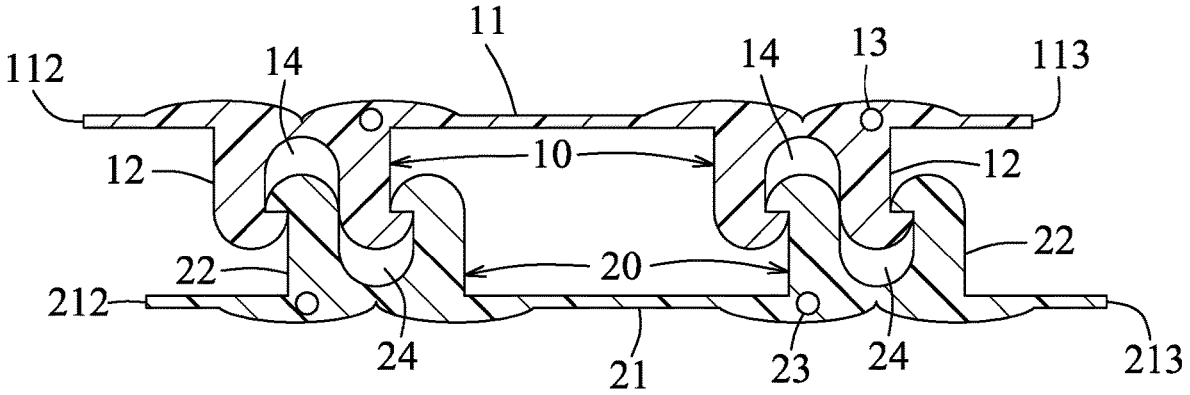
FIG. 5 is a sectional view similar to FIG. 2, illustrating the first and second strip halves of the first embodiment in a second engaging state.

Referring to FIGS. 4 and 5, the first and second strip halves 1, 2 are configured and dimensioned to be coupled with each other in two engaging states. In a first engaging state, as shown in FIG. 4, the first elongated hook 12 of each pair proximate to the first long side edge 112 is fitted securely in the corresponding second recess 24, and the second elongated hook 22 of each pair proximate to the fourth long side edge 213 is fitted securely in the corresponding first recess 14. Meanwhile, the first elongated hook 12 of each pair proximate to the second long side edge 113 is adjoined to and abuts against the corresponding second elongated hook 22 proximate to the fourth long side edge 213, and the second elongated hook 22 of each pair proximate to the third long side edge 212 is adjoined to and abuts against the corresponding first elongated hook 12 proximate to the first long side edge 112. In a second engaging state, as shown in FIG. 5, the first elongated hook 12 of each pair proximate to the second long side edge 113 is fitted securely in the corresponding second recess 24, and the second elongated hook 22 of each pair proximate to the third long side edge 212 is fitted securely in the corresponding first recess 14. Meanwhile, the first elongated hook 12 of each pair proximate to the first long side edge 112 is adjoined to and abuts against the corresponding second elongated hook 22 proximate to the third long side edge 212, and the second elongated hook 22 of each pair proximate to the fourth long side edge 213 is adjoined to and abuts against the corresponding first elongated hook 12 proximate to the second long side edge 113. Since the first and second strip halves 1, 2 can be coupled with each other in either the first engaging state or the second engaging state, the operation to close the fastener strip is convenient and easy to perform when only one of the first elongated hooks 12 is required to be fitted securely in the second recess 24. Moreover, the first and second elongated hooks 12, 22 proximate to the first and third long side edges 112, 212 can block most water from passing from the first and third long side edges 112, 212 through the second and fourth long side edges 113, 213, and the first and second elongated hooks 12, 22 proximate to the second and fourth long side edges 113, 213 can further block water from entering the fastener strip, which provides a suitable watertight seal.

Figure 6:
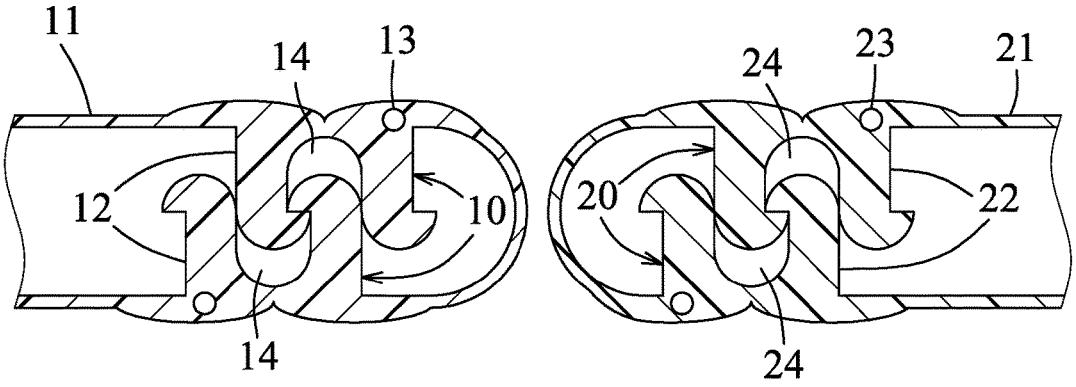
FIG. 6 is a sectional view illustrating the first embodiment in another state of use.

As illustrated in FIG. 6, each of the first and second strip halves 1, 2 can be made of a flexible material such that the first strip body 11 is bendable and foldable to permit each of the first elongated hooks 12 of one of the first hook units 10 to be fitted securely in the first recess 14 of the other one of the first hook units 10, and such that the second strip body 21 is bendable and foldable to permit each of the second elongated hooks 12 of one of the second hook units 20 to be fitted securely in the second recess 24 of the other one of the second hook units 20. For example, when the first and second strip halves 1, 2 are respectively mounted on left and right plackets of a garment, and when the left and right plackets are kept separated from each other, each of the first and second strip halves 1, 2 can be maintained in a bent and folded state to prevent entering of dirt and damage. It should be appreciated that the first and second strip halves 1, 2 are made from TPU (thermoplastic polyurethane) material.

Figure 7:
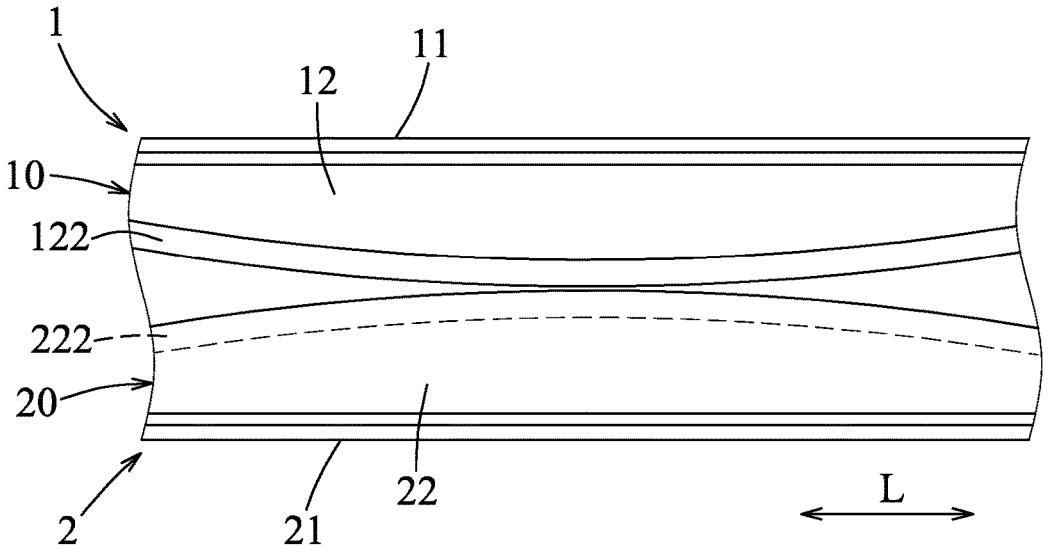
FIG. 7 is a fragmentary side view illustrating a second embodiment of the reclosable fastener strip according to the disclosure.

As illustrated in FIG. 7, in a second embodiment, lengths of the first elongated hooks 12 of each first hook unit 10 may gradually increase or decrease along the lengthwise direction (L), and lengths of the second elongated hooks 22 of each second hook unit 20 may gradually increase or decrease along the lengthwise direction (L). In this embodiment, the lengths of the first elongated hooks 12 gradually increase from two ends toward a center in the lengthwise direction (L), and the lengths of the second elongated hooks 22 gradually increase from two ends toward a center in the lengthwise direction (L), so as to provide different coupling strengths.

Figure 8:
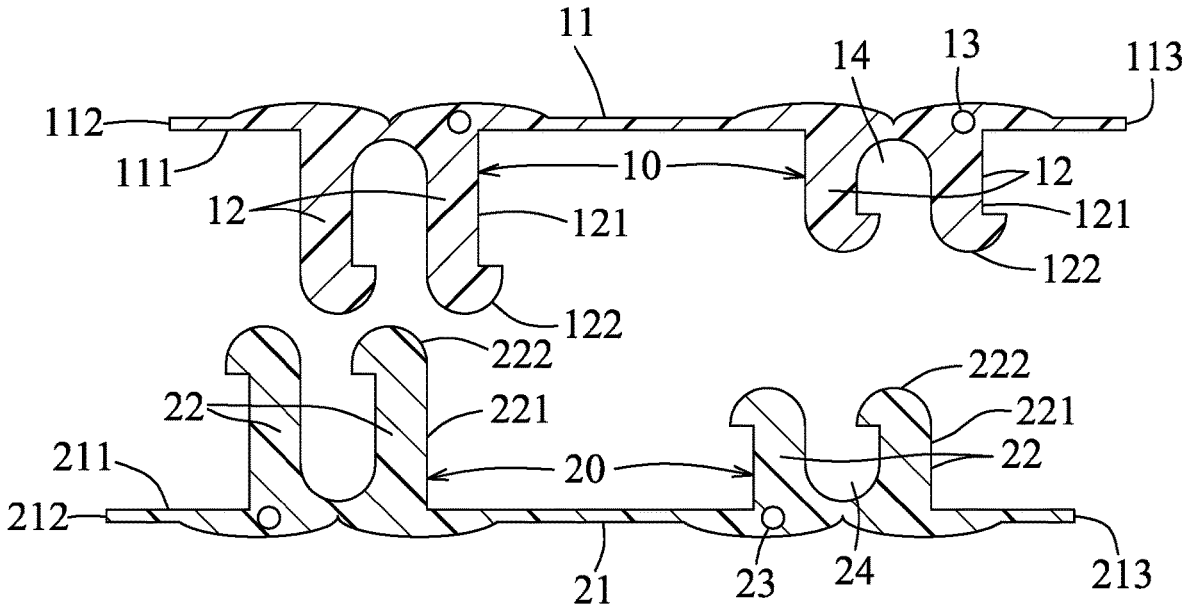
FIG. 8 is a sectional view illustrating a third embodiment of the reclosable fastener strip according to the disclosure.

As illustrated in FIG. 8, in a third embodiment, each of the first elongated hooks 12 of one of the first hook units 10 has a tip end which is distanced from the first major surface 111 by a first hook length. Each of the first elongated hooks of the other one of the first hook units 10 has a tip end which is distanced from the first major surface 111 by a second hook length that is different from the first hook length. Each of the second elongated hooks 22 of one of the second hook units 20 has a tip end which is distanced from the second major surface 211 by a third hook length. Each of the second elongated hooks of the other one of the second hook units 20 has a tip end which is distanced from the second major surface 211 by a fourth hook length that is different from the third hook length. Moreover, the thickness of the first enlarged head hook portion 122 of each first elongated hook 12 is larger than that of the first embodiment, and the thickness of the second enlarged head hook portion 222 of each second elongated hook 22 is larger than that of the first embodiment. Thus, the coupling strength of the first and second hook units 10, 20 of one pair is different from that of the other pair. In use, the user applies a force to separate one first hook unit 10 from the coupled second hook unit 20, and a larger force to separate the other first hook unit 10 from the corresponding coupled second hook unit 20.

Figure 9:
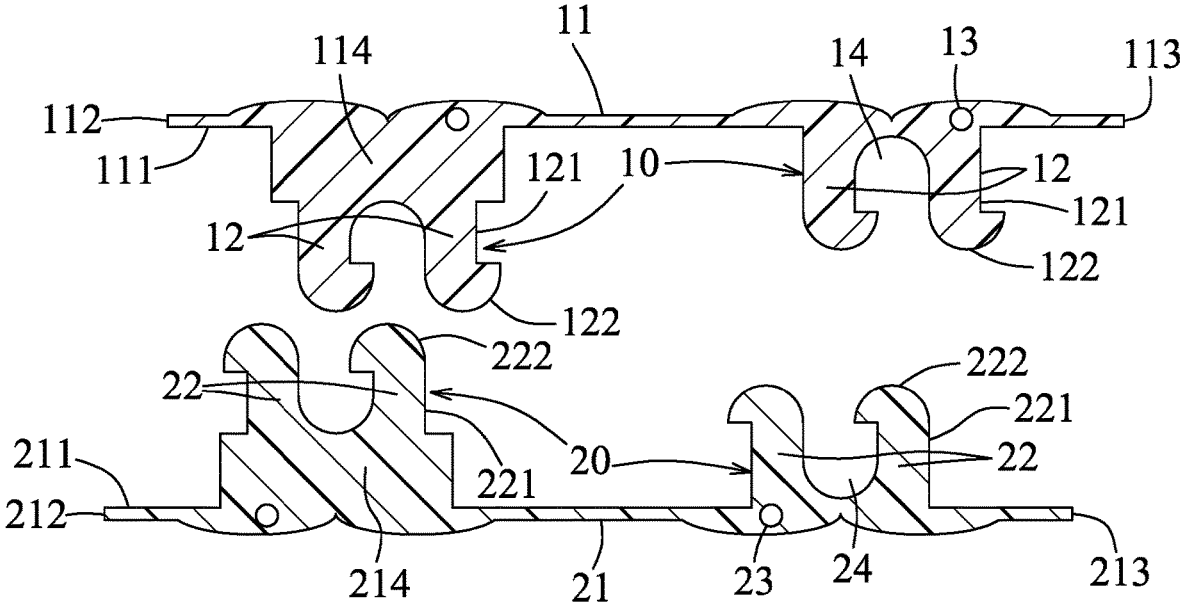
FIG. 9 is a sectional view illustrating a fourth embodiment of the reclosable fastener strip according to the disclosure.

As illustrated in FIG. 9, in a fourth embodiment, a first elongated protrusion 114 is formed on the first major surface 111 of the first strip body 11 to interconnect the first elongated hooks 12 of one first hook unit 10, and a second elongated protrusion 214 is formed on the second major surface 211 of the second strip body 21 to interconnect the second elongated hooks 22 of one second hook unit 20. The distance from the tip end of the first elongated hook 12 of the aforesaid first hook unit 10 to the first major surface 111 is different from that from the tip end of the first elongated hook 12 of the other first hook unit 10 to the first major surface 111, and the distance from the tip end of the second elongated hook 22 of the aforesaid second hook unit 20 to the second major surface 211 is different from that from the tip end of the second elongated hook 22 of the other second hook unit 20 to the second major surface 211. Moreover, the thickness of the first enlarged head hook portion 122 of each first elongated hook 12 is larger than that of the first embodiment, and the thickness of the second enlarged head hook portion 222 of each second elongated hook 22 is larger than that of the first embodiment. Thus, the coupling strength of the first and second hook units 10, 20 of one pair is different from that of the other pair. In use, the user applies a force to separate one first hook unit 10 from the coupled second hook unit 20, and a larger force to separate the other first hook unit 10 from the corresponding coupled second hook unit 20.

Figure 10:
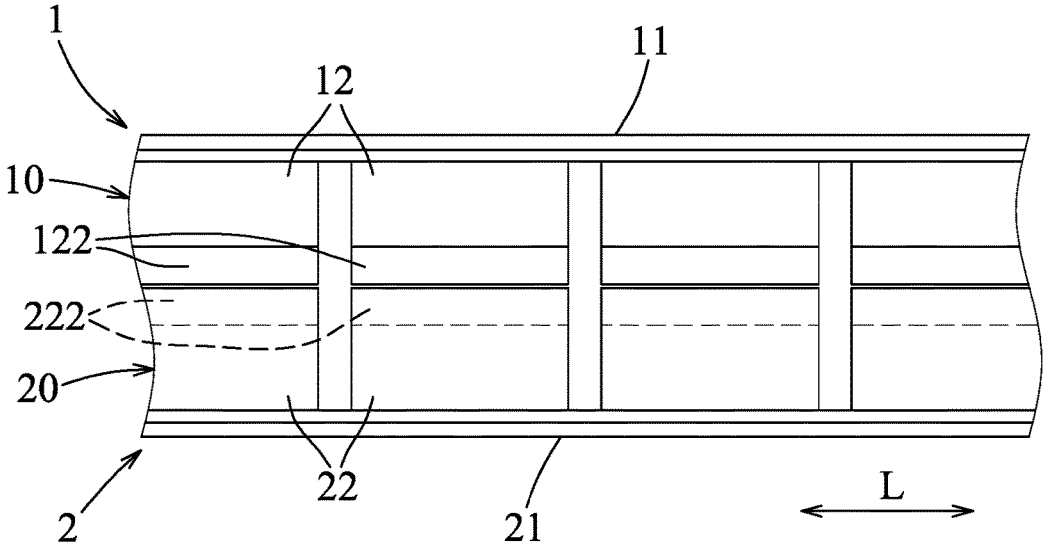
FIG. 10 is a fragmentary side view illustrating a fifth embodiment of the reclosable fastener strip according to the disclosure.

As illustrated in FIG. 10, in a fifth embodiment, each of the first hook units 10 has a plurality of pairs of the first elongated hooks 12 which are adjacent to and spaced apart from each other in the lengthwise direction (L), and each of the second hook units 20 has a plurality of pairs of the second elongated hooks 22 which are adjacent to and spaced apart from each other in the lengthwise direction (L).

Figure 11:
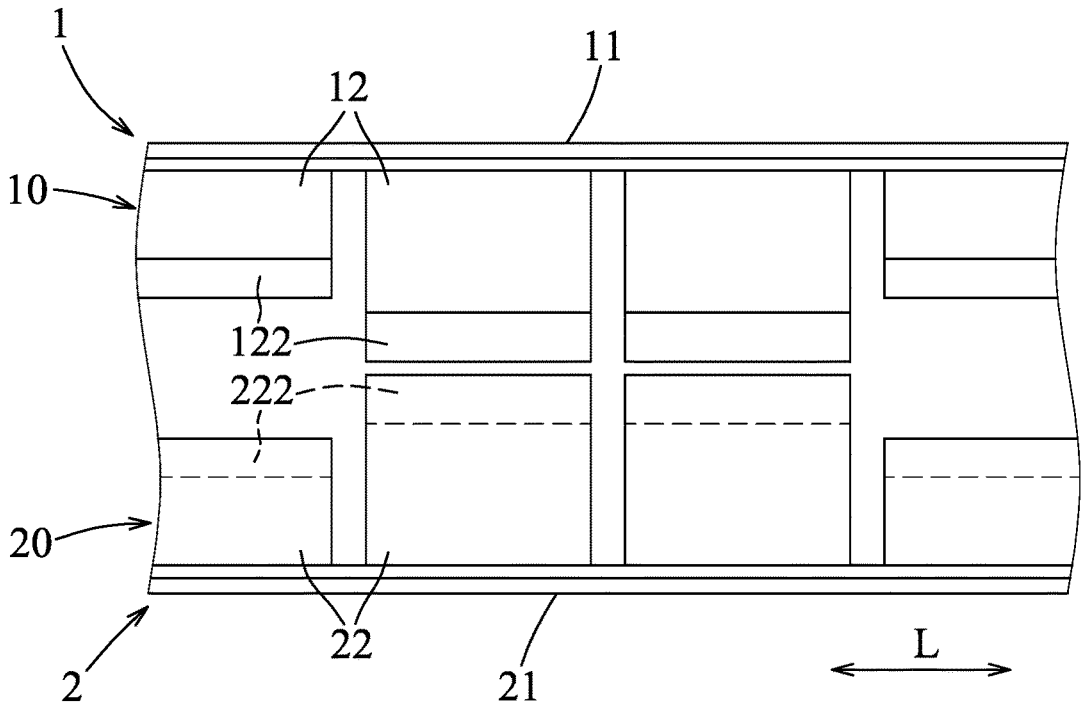
FIG. 11 is a fragmentary side view illustrating a sixth embodiment of the reclosable fastener strip according to the disclosure.

As illustrated in FIG. 11, in a sixth embodiment, each of the first hook units 10 has first and second pairs of the first elongated hooks 12. A length of the first elongated hooks 12 of the first pair is different from a length of the first elongated hooks 12 of the second pair. Each of the second hook units 20 has third and fourth pairs of the second elongated hooks 22. A length of the second elongated hooks 22 of the third pair is different from a length of the second elongated hooks 22 of the fourth pair. The second elongated hooks 22 of the third pair are configured and dimensioned to be fitted securely and respectively to the first elongated hooks 12 of the first pair. The second elongated hooks 22 of the fourth pair are configured and dimensioned to be fitted securely and respectively to the first elongated hooks 12 of the second pair. Specifically, in this embodiment, the first elongated hooks 12 of the first pair and the second elongated hooks 22 of the third pair are respectively located at a central portion of the first and second strip bodies 11, 21, and the first elongated hooks 12 of the second pair and the second elongated hooks 22 of the fourth pair are respectively located proximate to two ends of the first and second strip bodies 11, 21 in the lengthwise direction (L). The length of the hooks 12, 22 of the first and third pairs is larger than the length of the hooks 12, 22 of the second and fourth pairs.

Figure 12:
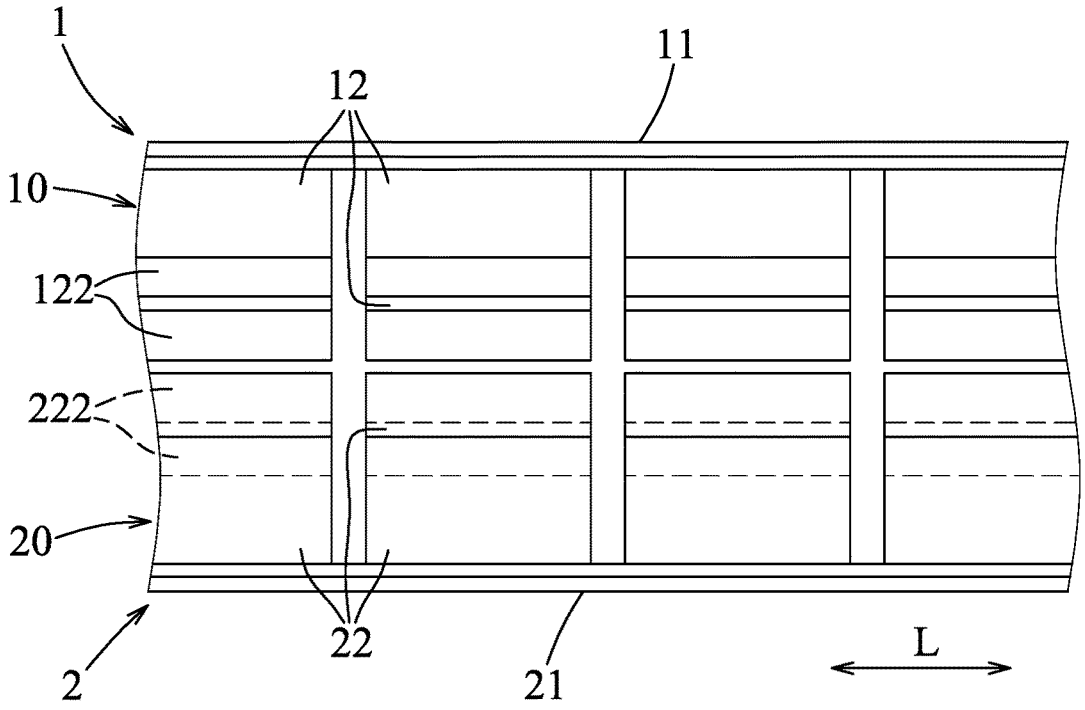
FIG. 12 is a fragmentary side view illustrating a seventh embodiment of the reclosable fastener strip according to the disclosure.

As illustrated in FIG. 12, in combination with FIG. 8, in a seventh embodiment, each of the first hook units 10 has a plurality of pairs of the first elongated hooks 12 which are adjacent to and spaced apart from each other in the lengthwise direction (L). Each of the second hook units 20 has a plurality of pairs of the second elongated hooks 22 which are adjacent to and spaced apart from each other in the lengthwise direction (L). Moreover, similar to those in the third embodiment, the length of the first elongated hooks 12 of one first hook unit 10 is different from that of the first elongated hooks 12 of another first hook unit 10, and the length of the second elongated hooks 12 of one second hook unit 20 is different from that of the second elongated hooks 12 of another second hook unit 20.

Figure 13:
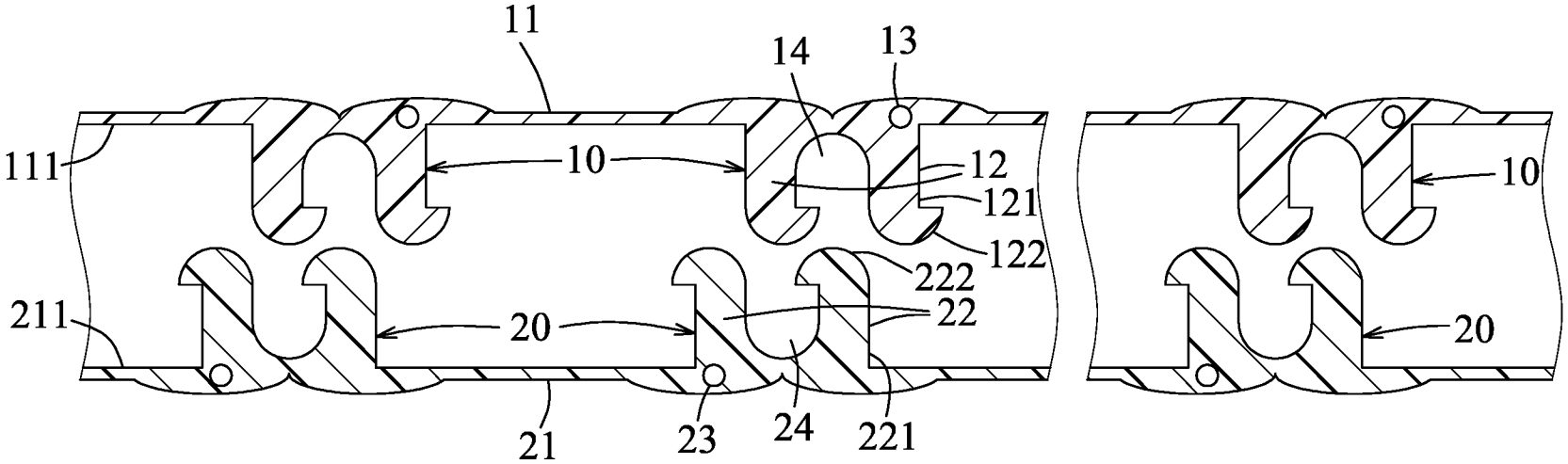
FIG. 13 is a fragmentary sectional view illustrating an eighth embodiment of the reclosable fastener strip according to the disclosure.

As illustrated in FIG. 13, in an eighth embodiment, the first strip half 1 has a plurality of the first hook units 10 spaced apart from one another, and the second strip half 2 has a plurality of the second hook units 20 spaced apart from one another, so as to provide a comparatively large coupling area to enhance the sealing effect. Moreover, each first hook unit 10 has a plurality of weakness lines (not shown) formed to interrupt the first elongated hooks 12 along the lengthwise direction (L), and each second hook unit 20 has a plurality of weakness lines (not shown) formed to interrupt the second elongated hooks 22 along the lengthwise direction (L), for facilitating engagement and disengagement of a portion of the first hook unit 10 with and from the corresponding second hook unit 20.

Figure 14:
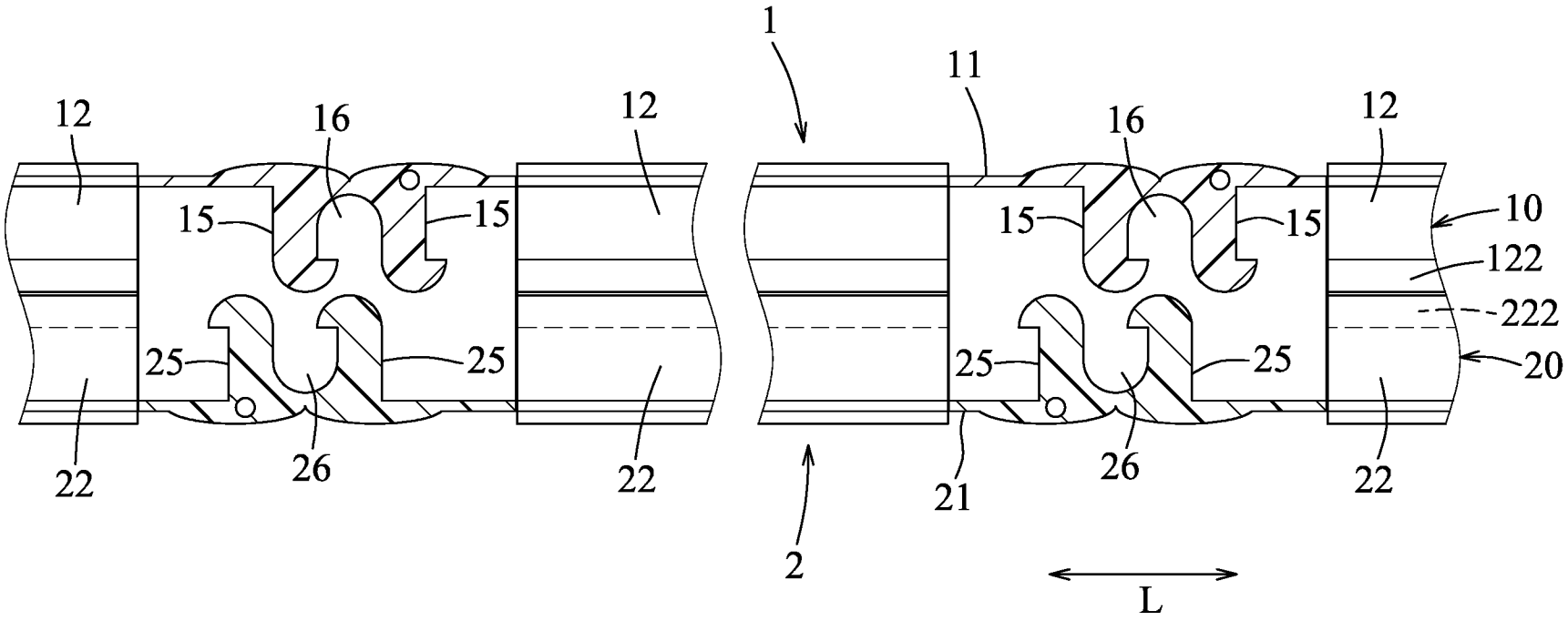
FIG. 14 is a fragmentary sectional view illustrating ninth and tenth embodiments of the reclosable fastener strip according to the disclosure.

As illustrated in FIG. 14, in a ninth embodiment, each of the first hook units 10 has a plurality of pairs of the first elongated hooks 12 which are adjacent to and spaced apart from each other in the lengthwise direction (L). The first strip half 1 further includes a plurality of pairs of third elongated hooks 15. The third elongated hooks 15 of each pair are formed on the first major surface 111 of the first strip body 11 and are interposed between the first elongated hooks 12 of two adjacent pairs, and project from the first major surface 111 in a transverse direction that is transverse to the lengthwise direction (L). The third elongated hooks 15 of each pair cooperatively define a third recess 16 therebetween. Each of the second hook units 20 has a plurality of pairs of the second elongated hooks 22 which are adjacent to and spaced apart from each other in the lengthwise direction (L). The second strip half 2 further includes a plurality of pairs of fourth elongated hooks 25. The fourth elongated hooks 25 of each pair are formed on the second major surface 211 of the second strip body 21 and are interposed between the second elongated hooks 22 of two adjacent pairs, and project from the second major surface 211 in the transverse direction. The fourth elongated hooks 25 of each pair cooperatively define a fourth recess 26 therebetween. Each of the third and fourth elongated hooks 15, 25 is configured and dimensioned to permit each of the third elongated hooks 15 to be fitted securely in the fourth recess 26, and to permit each of the fourth elongated hooks 25 to be fitted securely in the third recess 16. Specifically, in this embodiment, when the first and second strip halves 1, 2 are respectively mounted on left and right plackets of a garment, the third and fourth elongated hooks 15, 25 can serve as button fasteners. A portion of the left placket can be engaged with or disengaged from the right placket as desired while obtaining a greater watertight seal of the left and right plackets as compared with conventional buttons. It should be appreciated that the transverse direction that is transverse to the lengthwise direction (L) may be perpendicular to or inclined relative to the lengthwise direction (L). In this embodiment, two of the first hook units 10 and two of the second hook units 20 are disposed on the first and second strip bodies 11, 21, respectively. In a variant tenth embodiment, more than two of the first hook units 10 and more than two of the second hook units 20 are provided and are spaced apart from one another.

Figure 15:
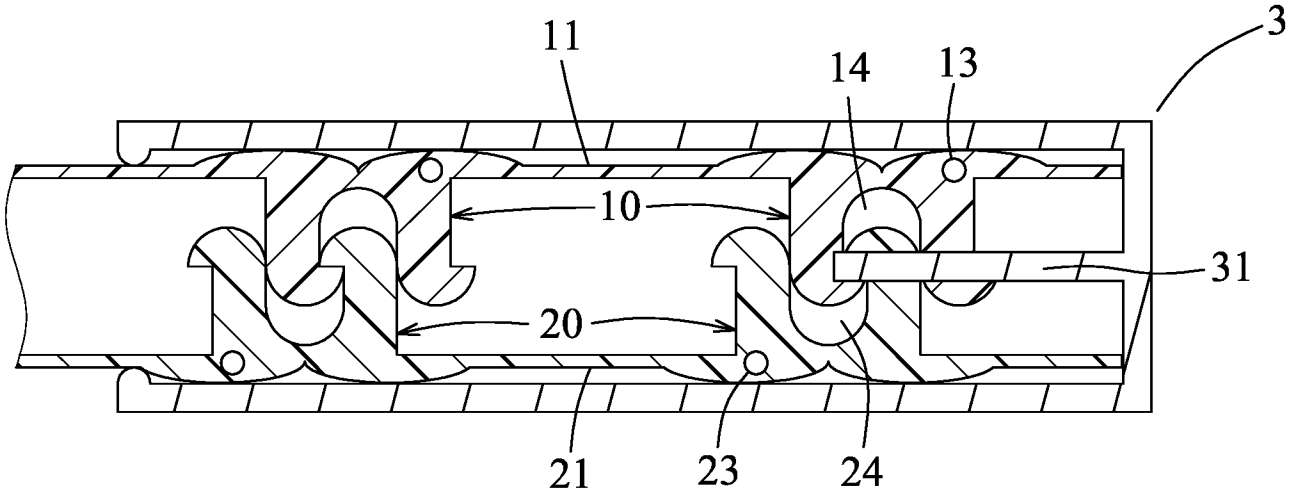
FIG. 15 is a fragmentary sectional view illustrating an eleventh embodiment of the reclosable fastener strip according to the disclosure.

As illustrated in FIG. 15, in an eleventh embodiment, a slider closure 3 is movably disposed on the first and second strip halves 1, 2 in the lengthwise direction (L), and has a dividing portion 31 for facilitating engaging and releasing the first strip half 1 with and from the second strip half 2. The dividing portion 31 may be of T or arrow shape.

Figure 16:
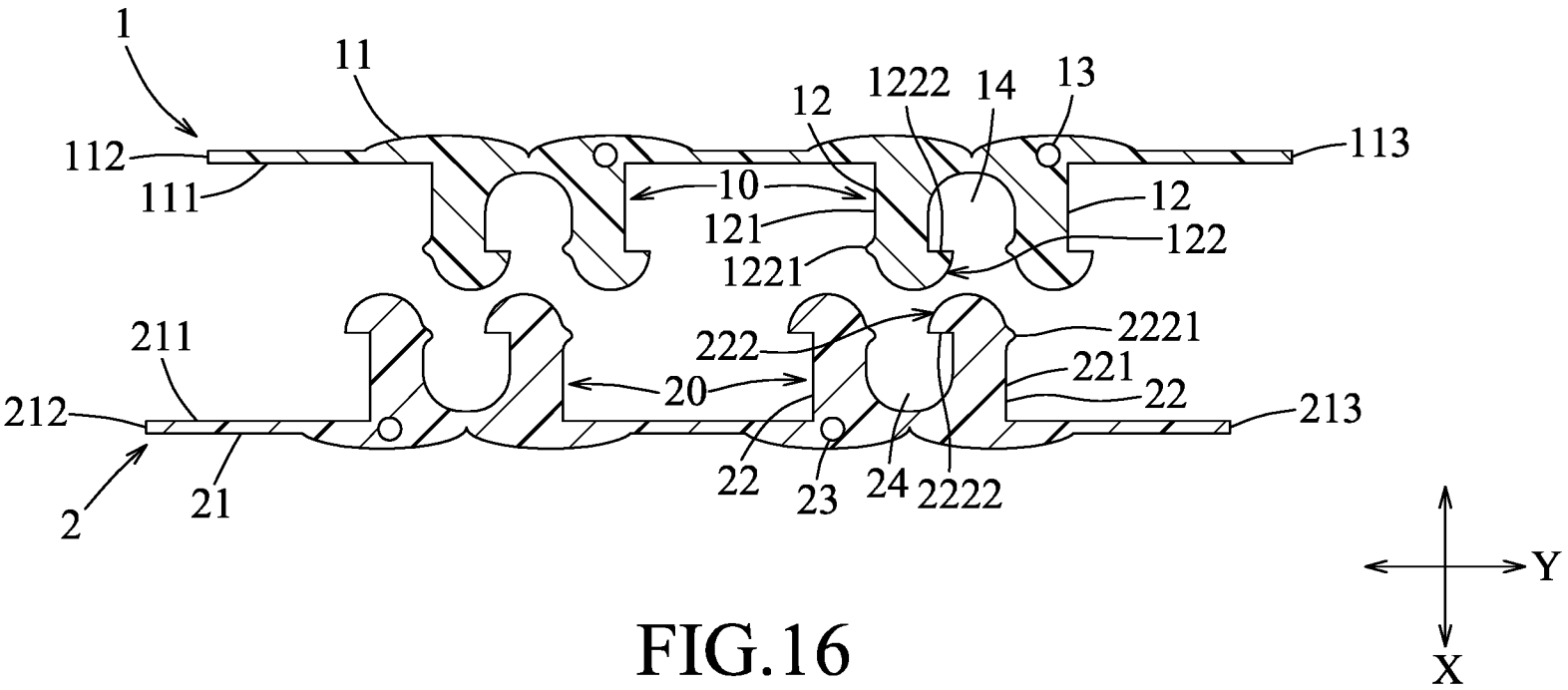
FIG. 16 is a sectional view illustrating a twelfth embodiment of the reclosable fastener strip according to the disclosure.
Figure 17:
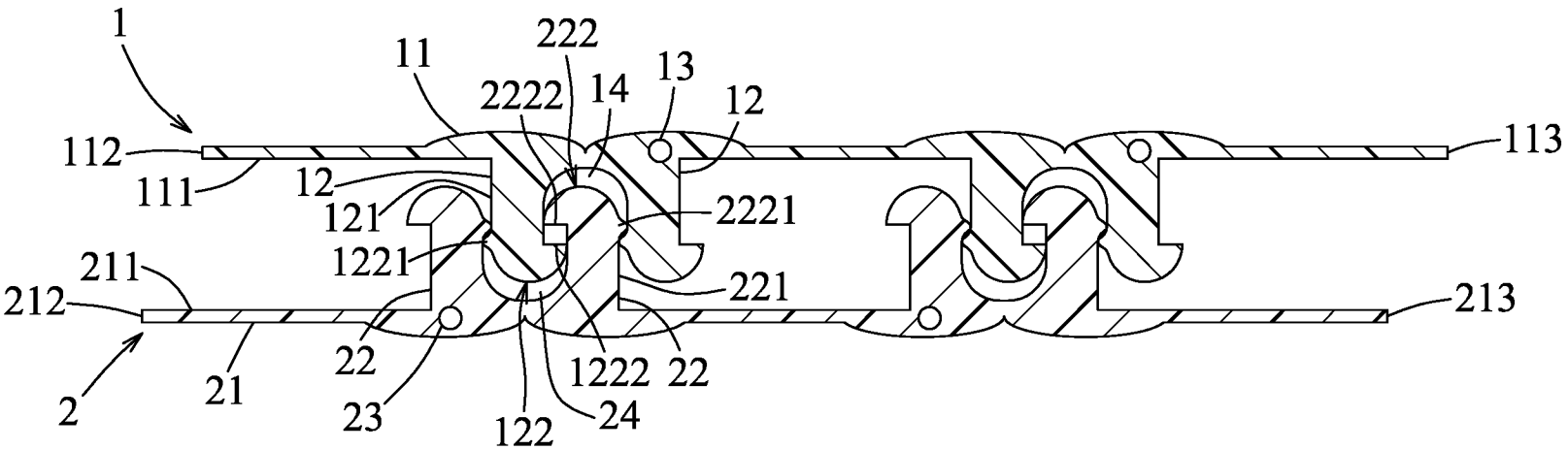
FIG. 17 is a sectional view similar to FIG. 16, illustrating first and second strip halves of the twelfth embodiment in a first engaging state.
Figure 18:
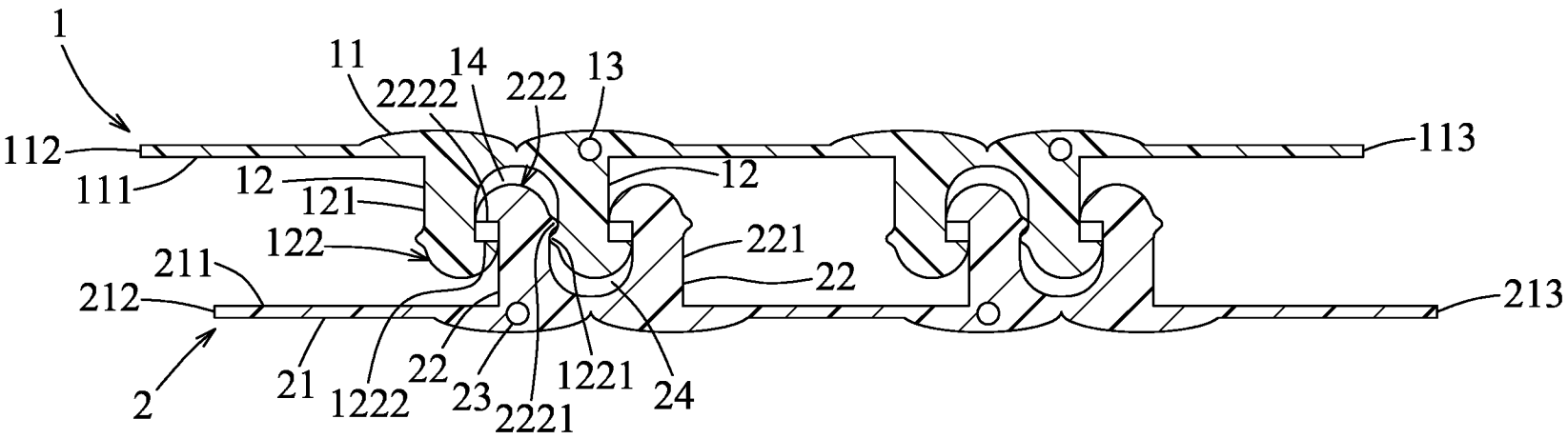
FIG. 18 is a sectional view similar to FIG. 16, illustrating the first and second strip halves of the twelfth embodiment in a second engaging state.

As illustrated in FIG. 16, in a twelfth embodiment, the first enlarged head hook portion 122 of each first elongated hook 12 has a first engaging protrusion 1221 and a first face 1222 formed adjacent to the first neck portion 121 and opposite to each other in the lateral direction (Y). The second enlarged head hook portion 222 of each second elongated hook 22 has a second engaging protrusion 2221 and a second face 2222 formed adjacent to the second neck portion 221 and opposite to each other in the lateral direction (Y). The first and second faces 1222, 2222 are formed normal to the engaging direction (X), and respectively face the first and second major surfaces 111, 211. As shown in FIGS. 17 and 18, when the first elongated hook 12 is fitted securely in the second recess 24 in either the first engaging state or the second engaging state, the first engaging protrusion 1221 is engaged with the second engaging protrusion 2221 in the engaging direction (X), and the first face 1222 and the second face 2222 face each other in the engaging direction (X). The engagement of the first and second engaging protrusions 1221, 2221 can enhance the watertight seal of the first and second strip halves 1, 2.

Figure 19:
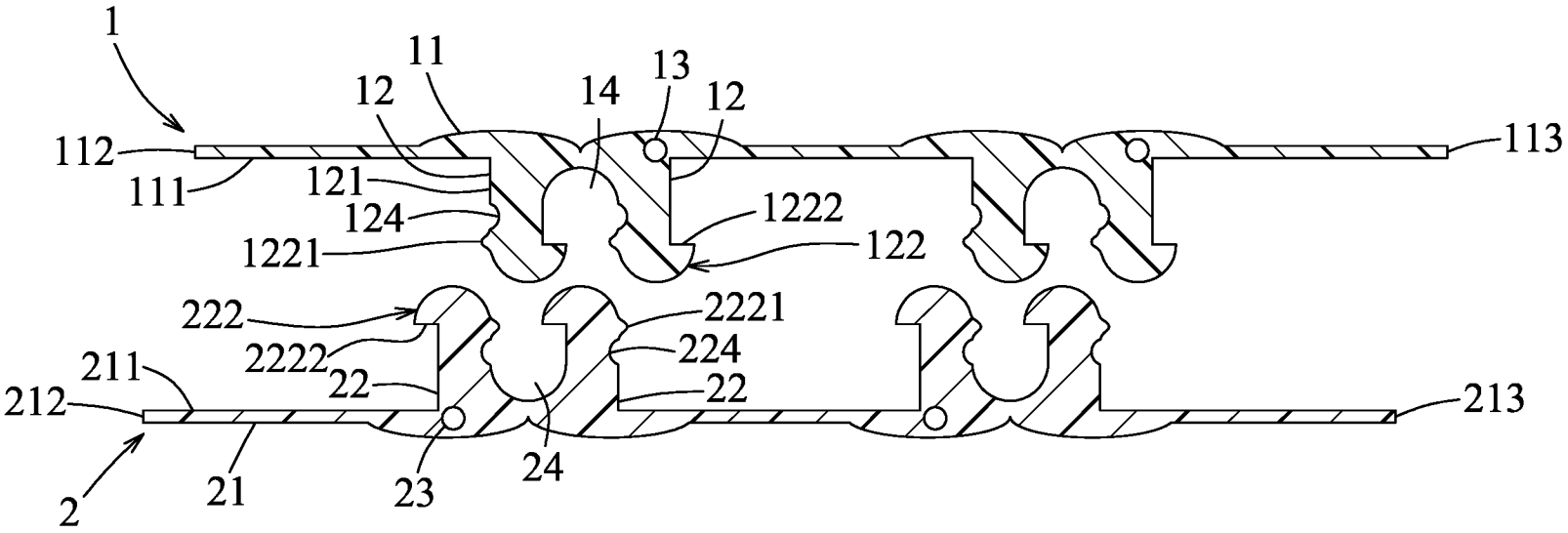
FIG. 19 is a sectional view illustrating a thirteenth embodiment of the reclosable fastener strip according to the disclosure.
Figure 20:
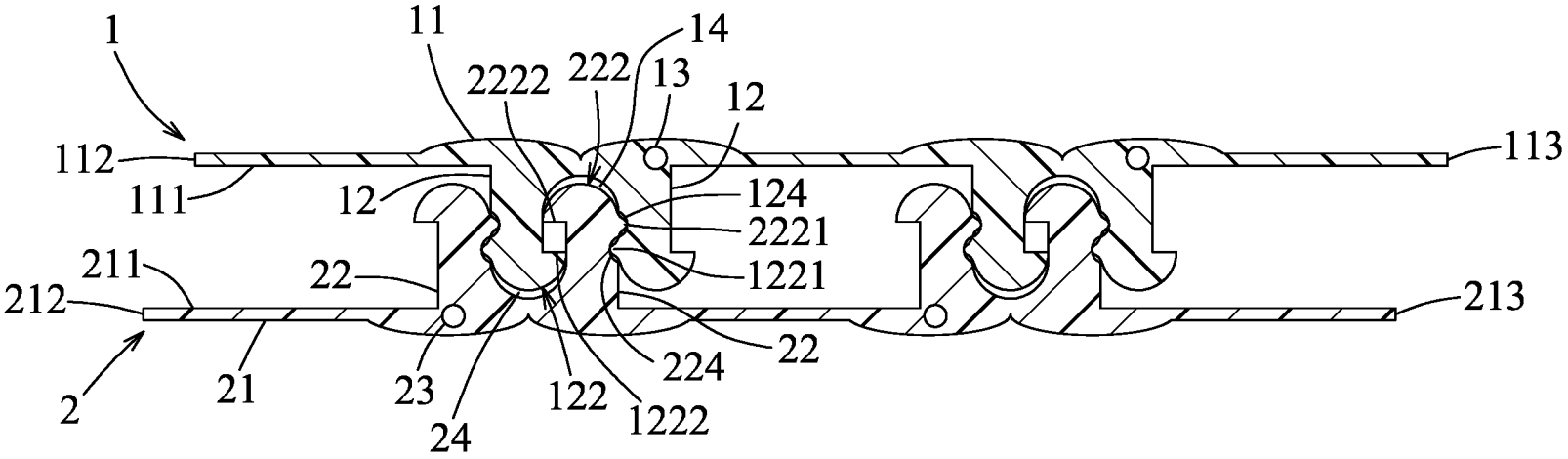
FIG. 20 is a sectional view similar to FIG. 19, illustrating first and second strip halves of the thirteenth embodiment in an engaging state.

As illustrated in FIGS. 19 and 20, in a thirteenth embodiment, the first neck portion 121 of each first elongated hook 12 has a first cavity 124 formed adjacent to the first enlarged head hook portion 122 for engagement of the second engaging protrusion 2221 of the corresponding second elongated hook 22 therein. The second neck portion 221 of each second elongated hook 22 has a second cavity 224 for engagement of the first engaging protrusion 1221 of the corresponding first elongated hook 12 therein.

Figure 21:
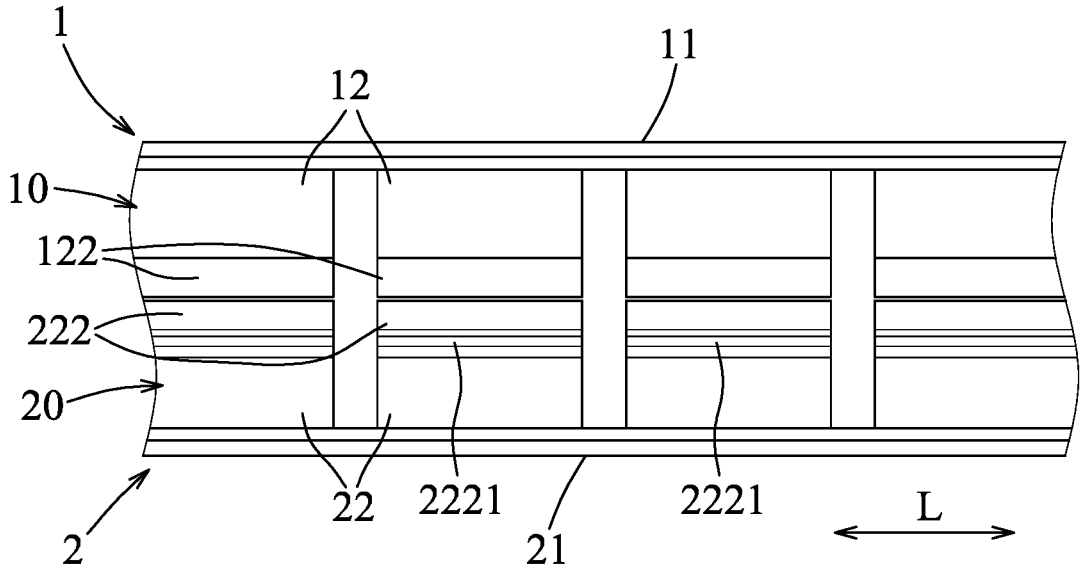
FIG. 21 is a fragmentary side view illustrating a fourteenth embodiment of the reclosable fastener strip according to the disclosure.

As illustrated in FIG. 21, in a fourteenth embodiment, each first hook unit 10 has a plurality of pairs of the first elongated hooks 12 which are adjacent to and spaced apart from each other in the lengthwise direction (L), and each second hook unit 20 has a plurality of pairs of the second elongated hooks 22 which are adjacent to and spaced apart from each other in the lengthwise direction (L). Similar to the previous embodiments, each of the first and second elongated hooks 12, 22 has a first or second engaging protrusion 1221, 2221.

Figure 22:
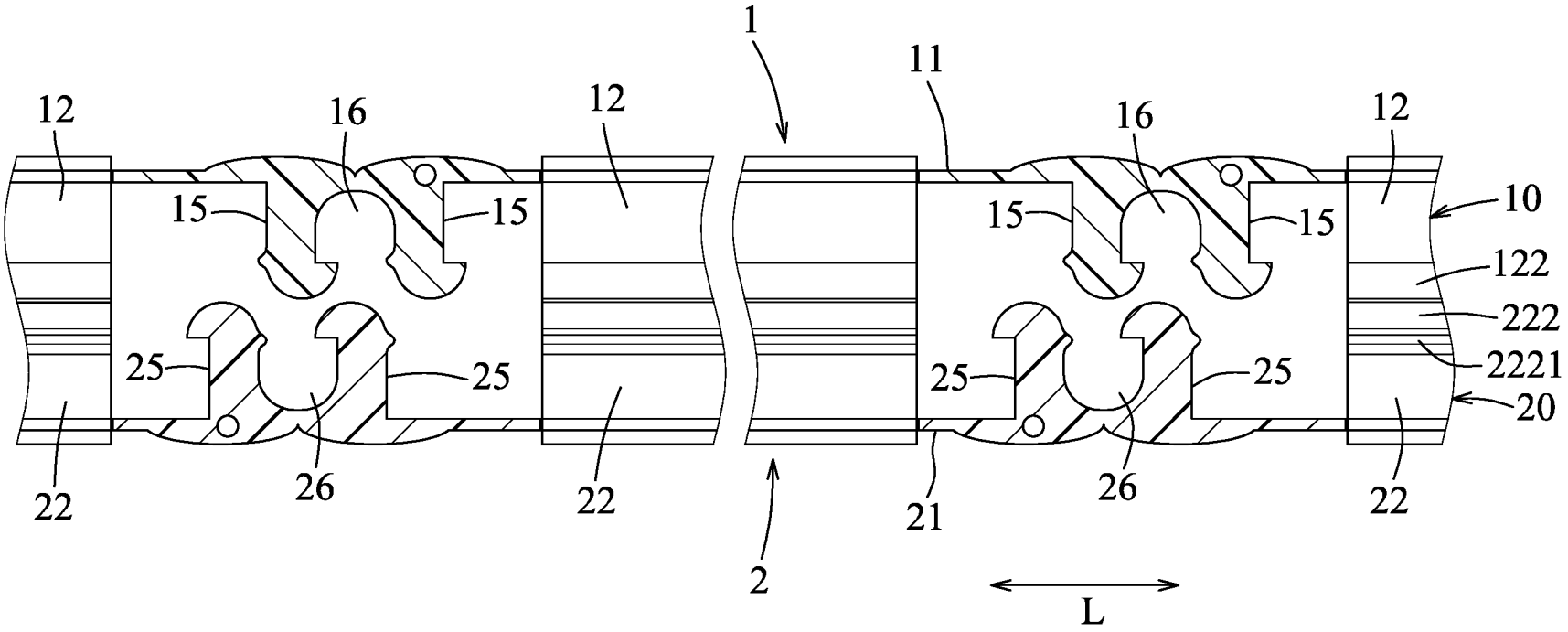
FIG. 22 is a fragmentary sectional view illustrating a fifteenth embodiment of the reclosable fastener strip according to the disclosure.

As illustrated in FIG. 22, in a fifteenth embodiment, similar to the previous ninth embodiment shown in FIG. 14, the first strip half 1 further includes a plurality of pairs of third elongated hooks 15. The second strip half 2 further includes a plurality of pairs of fourth elongated hooks 25. Similar to the previous embodiments, each of the first, second, third and fourth elongated hooks 12, 22, 15, 25 has an engaging protrusion.

Figure 23:
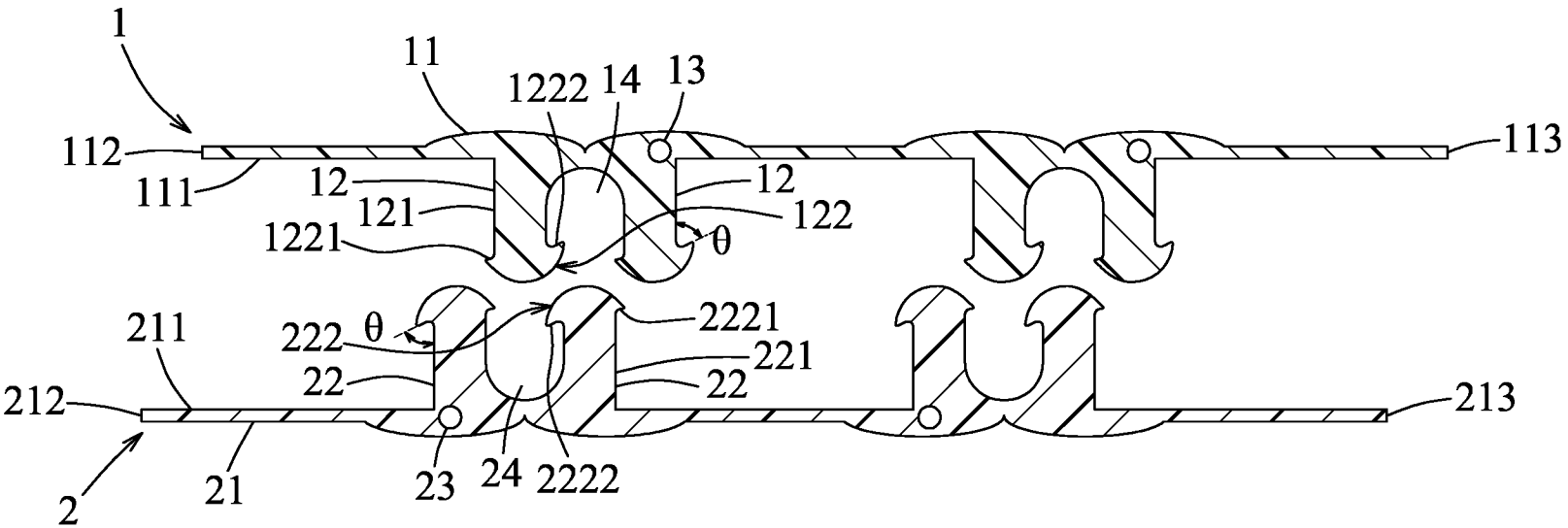
FIG. 23 is a sectional view illustrating a sixteenth embodiment of the reclosable fastener strip according to the disclosure.

As illustrated in FIG. 23, in a sixteenth embodiment, the first and second faces 1222, 2222 are respectively inclined to the first and second neck portions 121, 221 by an included angle that is less than 90 degrees. Specifically, each of the first and second enlarged head hook portions 122, 222 is of a sharp barb shape for enhancing the fitted engagement of the first and second elongated hooks 12, 22.

Figure 24:
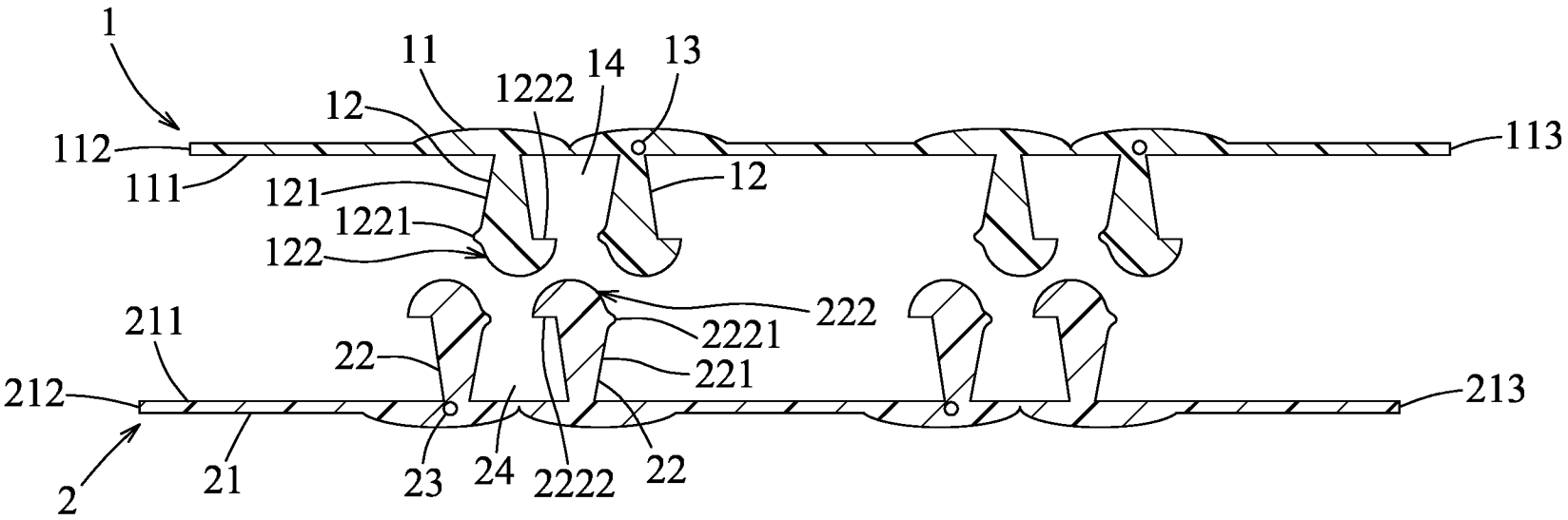
FIG. 24 is a sectional view illustrating a seventeenth embodiment of the reclosable fastener strip according to the disclosure.
Figure 25:
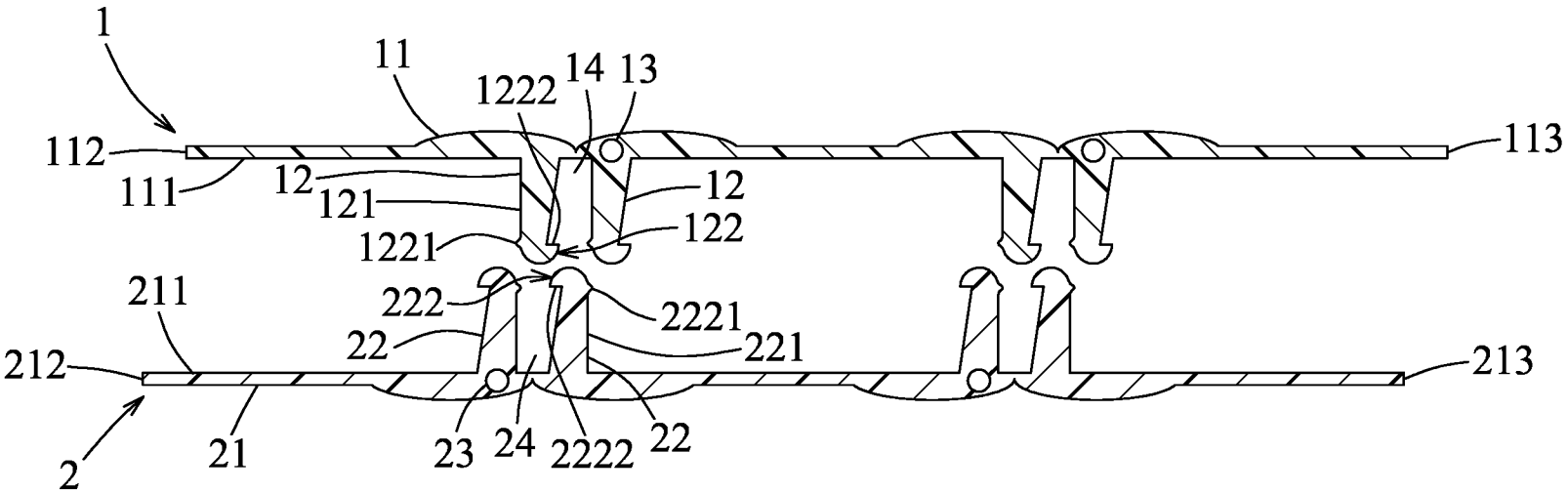
FIG. 25 is a sectional view illustrating an eighteenth embodiment of the reclosable fastener strip according to the disclosure.

As illustrated in FIG. 24, in a seventeenth embodiment, a width of the first neck portion 121 gradually increases along the engaging direction (X) from the first major surface 111 to the first enlarged head hook portion 122, and a width of the second neck portion 221 gradually increases along the engaging direction (X) from the second major surface 211 to the second enlarged head hook portion 222, for enhancing the fitted engagement of the first and second elongated hooks 12, 22. Alternatively, as illustrated in FIG. 25, in an eighteenth embodiment, a width of the first neck portion 121 gradually decreases along the engaging direction (X) from the first major surface 111 to the first enlarged head hook portion 122, and a width of the second neck portion 221 gradually decreases along the engaging direction (X) from the second major surface 211 to the second enlarged head hook portion 222, for enhancing the fitted engagement of the first and second elongated hooks 12, 22.

Figure 26:
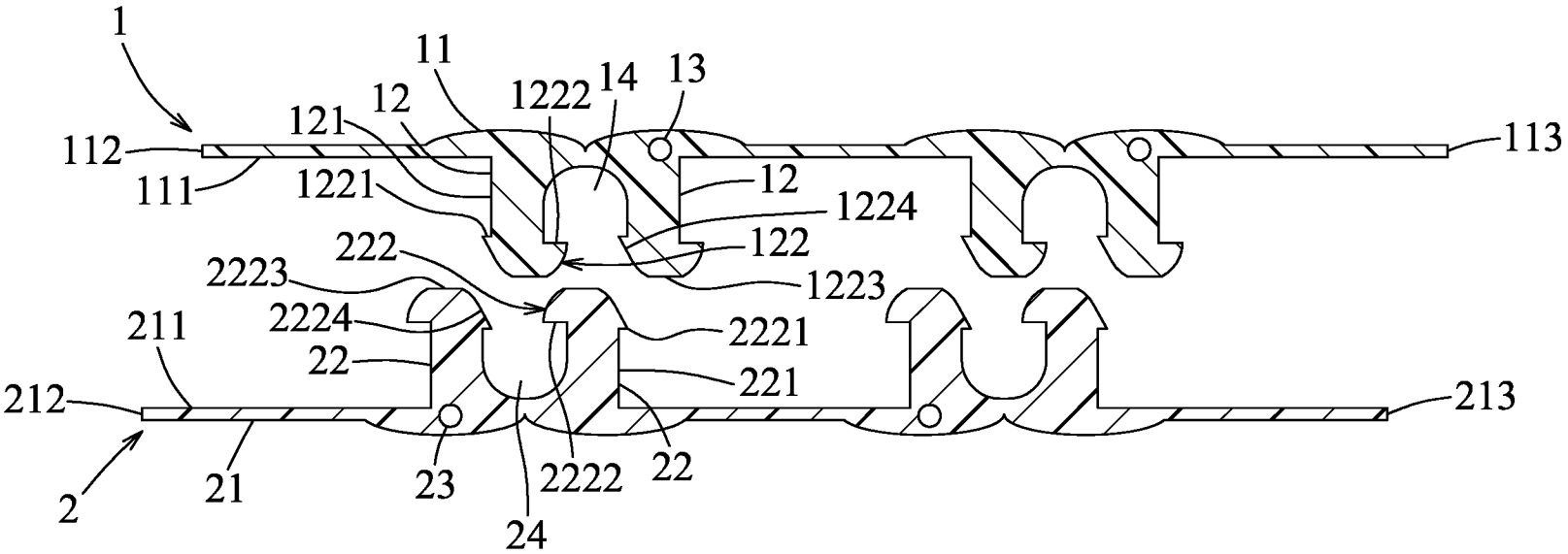
FIG. 26 is a sectional view illustrating a nineteenth embodiment of the reclosable fastener strip according to the disclosure.

As illustrated in FIG. 26, in a nineteenth embodiment, each of the first and second enlarged head hook portions 122, 222 is frusto-conical and has a parallel tip surface 1223, 2223 and a tilt side surface 1224, 2224 between the parallel tip surface 1223, 2223 and a respective one of the first and second engaging protrusions 1221, 2221.

Figure 27:
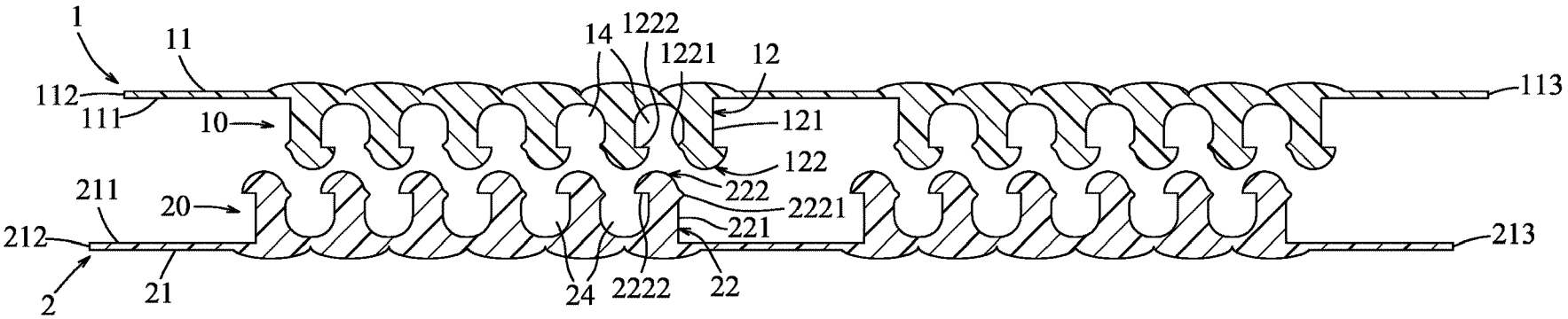
FIG. 27 is a sectional view illustrating a twentieth embodiment of the reclosable fastener strip according to the disclosure.

As illustrated in FIG. 27, in a twentieth embodiment, each first hook unit 10 has a plurality of pairs of the first elongated hooks 12 which are adjoined to each other in the lengthwise direction (L) such that a first recess 14 is defined between two adjacent ones of the first elongated hooks 12, and each second hook units 20 has a plurality of pairs of the second elongated hooks 22 which are adjoined to each other in the lengthwise direction (L) such that a second recess 24 is defined between two adjacent ones of the second elongated hooks 22.

Furthermore, the first and second elongated hooks 12, 22 have frictional surfaces for facilitating the fitted engagement therebetween.

With the first and second strip halves 1, 2 configured and dimensioned to be coupled with each other in two engaging states, the operation to close the reclosable fastener strip is convenient and easy to perform. Moreover, with at least two of the first hook units 10 and at least two of the second hook units 20, a suitable watertight seal is provided.

In the description above, for the purposes of explanation, numerous specific details have been set forth in order to provide a thorough understanding of the embodiments. It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects.

While the disclosure has been described in connection with what are considered the exemplary embodiments, it is understood that this disclosure is not limited to the disclosed embodiments but is intended to cover various arrangements included within the spirit and scope of the broadest interpretation so as to encompass all such modifications and equivalent arrangements.

What is claimed is:

1. A reclosable fastener strip comprising:

a first strip half including a first strip body which is elongated in a lengthwise direction and which has a first major surface that faces in an engaging direction transverse to the lengthwise direction, and first and second long side edges opposite to each other in a lateral direction transverse to both the lengthwise and engaging directions, and two first hook units which are spaced apart from each other in the lateral direction, each of said first hook units having at least one pair of first elongated hooks, each of which is formed on said first major surface and elongated in the lengthwise direction, said first elongated hooks of each pair being respectively disposed proximate to said first and second long side edges and cooperatively define a first recess therebetween; and a second strip half including a second strip body which is elongated in the lengthwise direction and which has a second major surface that faces in the engaging direction and said first major surface, and third and fourth long side edges opposite to each other in the lateral direction, and two second hook units which are spaced apart from each other in the lateral direction, each of said second hook units having at least one pair of second elongated hooks, each of which is formed on said second major surface and elongated in the lengthwise direction, said second elongated hooks of each pair being respectively disposed proximate to said third and fourth long side edges and cooperatively define a second recess therebetween, each of said first and second elongated hooks having a frictional surface to permit each of said first elongated hooks to be fitted securely in said second recess, and to permit each of said second elongated hooks to be fitted securely in said first recess.

2. The reclosable fastener strip as claimed in claim 1, wherein each of said first hook units has a plurality of pairs of said first elongated hooks which are adjacent to and spaced apart from each other in the lengthwise direction, and each of said second hook units has a plurality of pairs of said second elongated hooks which are adjacent to and spaced apart from each other in the lengthwise direction.

3. The reclosable fastener strip as claimed in claim 2, wherein said first strip half further includes a plurality of pairs of third elongated hooks, said third elongated hooks of each pair being formed on said first major surface and interposed between said first elongated hooks of two adjacent pairs, and projecting from said first major surface in a transverse direction that is transverse to the lengthwise direction, said third elongated hooks of each pair cooperatively defining a third recess therebetween, said second strip half further including a plurality of pairs of fourth elongated hooks, said fourth elongated hooks of each pair being formed on said second major surface and interposed between said second elongated hooks of two adjacent pairs, and projecting from said second major surface in the transverse direction, said fourth elongated hooks of each pair cooperatively defining a fourth recess therebetween, each of said third and fourth elongated hooks being configured and dimensioned to permit each of said third elongated hooks to be fitted securely in said fourth recess, and to permit each of said fourth elongated hooks to be fitted securely in said third recess.

4. A reclosable fastener strip comprising:

a first strip half including a first strip body which is elongated in a lengthwise direction and which has a first major surface that faces in an engaging direction transverse to the lengthwise direction, and first and second long side edges opposite to each other in a lateral direction transverse to both the lengthwise and engaging directions, and two first hook units which are spaced apart from each other in the lateral direction, each of said first hook units having at least one pair of first elongated hooks, each of which is formed on said first major surface and elongated in the lengthwise direction, said first elongated hooks of each pair being respectively disposed proximate to said first and second long side edges and cooperatively define a first recess therebetween; and a second strip half including a second strip body which is elongated in the lengthwise direction and which has a second major surface that faces in the engaging direction and said first major surface, and third and fourth long side edges opposite to each other in the lateral direction, and two second hook units which are spaced apart from each other in the lateral direction, each of said second hook units having at least one pair of second elongated hooks, each of which is formed on said second major surface and elongated in the lengthwise direction, said second elongated hooks of each pair being respectively disposed proximate to said third and fourth long side edges and cooperatively define a second recess therebetween, each of said first and second elongated hooks being configured and dimensioned to permit each of said first elongated hooks to be fitted securely in said second recess, and to permit each of said second elongated hooks to be fitted securely in said first recess, wherein each of said first elongated hooks of one of said first hook units has a tip end which is distanced from said first major surface by a first hook length, each of said first elongated hooks of the other one of said first hook units having a tip end which is distanced from said first major surface by a second hook length that is different from the first hook length, each of said second elongated hooks of one of said second hook units having a tip end which is distanced from said second major surface by a third hook length, each of said second elongated hooks of the other one of said second hook units having a tip end which is distanced from said second major surface by a fourth hook length that is different from the third hook length.

5. The reclosable fastener strip as claimed in claim 2, wherein each of said first hook units has first and second pairs of said first elongated hooks, a length of said first elongated hooks of said first pair being different from a length of said first elongated hooks of said second pair, each of said second hook units having third and fourth pairs of said second elongated hooks, a length of said second elongated hooks of said third pair being different from a length of said second elongated hooks of said fourth pair, said second elongated hooks of said third pair being configured and dimensioned to be fitted securely and respectively to said first elongated hooks of said first pair, said second elongated hooks of said fourth pair being configured and dimensioned to be fitted securely and respectively to said first elongated hooks of said second pair.

6. A reclosable fastener strip comprising:

a first strip half including a first strip body which is elongated in a lengthwise direction and which has a first major surface that faces in an engaging direction transverse to the lengthwise direction, and first and second long side edges opposite to each other in a lateral direction transverse to both the lengthwise and engaging directions, and two first hook units which are spaced apart from each other in the lateral direction, each of said first hook units having at least one pair of first elongated hooks, each of which is formed on said first major surface and elongated in the lengthwise direction, said first elongated hooks of each pair being respectively disposed proximate to said first and second long side edges and cooperatively define a first recess therebetween; and a second strip half including a second strip body which is elongated in the lengthwise direction and which has a second major surface that faces in the engaging direction and said first major surface, and third and fourth long side edges opposite to each other in the lateral direction, and two second hook units which are spaced apart from each other in the lateral direction, each of said second hook units having at least one pair of second elongated hooks, each of which is formed on said second major surface and elongated in the lengthwise direction, said second elongated hooks of each pair being respectively disposed proximate to said third and fourth long side edges and cooperatively define a second recess therebetween, each of said first and second elongated hooks being configured and dimensioned to permit each of said first elongated hooks to be fitted securely in said second recess, and to permit each of said second elongated hooks to be fitted securely in said first recess, wherein lengths of said first elongated hooks of each of said first hook units gradually change in one of increasing and decreasing manners along the lengthwise direction, and lengths of said second elongated hooks of each of said second hook units gradually change in one of increasing and decreasing manners along the lengthwise direction.

7. The reclosable fastener strip as claimed in claim 1, wherein said first strip body is bendable and foldable to permit each of said first elongated hooks of one of said first hook units to be fitted securely in said first recess of the other one of said first hook units, and said second strip body is bendable and foldable to permit each of said second elongated hooks of one of said second hook units to be fitted securely in said second recess of the other one of said second hook units.

8. The reclosable fastener strip as claimed in claim 1, further comprising a slider closure which is movably disposed on said first and second strip halves in the lengthwise direction for facilitating engaging and releasing said first strip half with and from said second strip half.

9. The reclosable fastener strip as claimed in claim 1, wherein each of said first elongated hooks includes a first neck portion which extends from said first major surface in the engaging direction to terminate at a first enlarged head hook portion that is spaced apart from said first major surface, and each of said second elongated hooks includes a second neck portion which extends from said second major surface in the engaging direction to terminate at a second enlarged head hook portion that is spaced apart from said second major surface.

10. The reclosable fastener strip as claimed in claim 9, wherein said first enlarged head hook portion has a first engaging protrusion and a first face formed adjacent to said first neck portion and opposite to each other in the lateral direction, said second enlarged head hook portion having a second engaging protrusion and a second face formed adjacent to said second neck portion and opposite to each other in the lateral direction, said first engaging protrusion being engaged with said second engaging protrusion in the engaging direction when said first elongated hook is fitted securely in said second recess.

11. The reclosable fastener strip as claimed in claim 10, wherein said first neck portion has a first cavity formed adjacent to said first enlarged head hook portion for engagement of said second engaging protrusion therein, said second neck portion having a second cavity for engagement of said first engaging protrusion therein.

12. The reclosable fastener strip as claimed in claim 10, wherein said first face and said second face respectively face said first and second major surfaces to face each other in the engaging direction when said first elongated hook is fitted securely in said second recess.

13. The reclosable fastener strip as claimed in claim 12, wherein each of said first and second faces is formed normal to the engaging direction.

14. The reclosable fastener strip as claimed in claim 12, wherein said first and second faces are respectively inclined to said first and second neck portions by an included angle less than 90 degrees.

15. The reclosable fastener strip as claimed in claim 10, wherein a width of said first neck portion gradually changes in one of increasing and decreasing manners along the engaging direction from said first major surface to said first enlarged head hook portion, and a width of said second neck portion gradually changes in one of increasing and decreasing manners along the engaging direction from said second major surface to said second enlarged head hook portion.

16. The reclosable fastener strip as claimed in claim 10, wherein each of said first and second enlarged head hook portions is frusto-conical and has a parallel tip surface and a tilt side surface between said parallel tip surface and a respective one of said first and second engaging protrusions.

* * * * *